United States Patent [19]

Penven

[11] Patent Number: 4,902,383

[45] Date of Patent: Feb. 20, 1990

[54] METHOD OF MAKING A PAPERMAKER'S FELT WITH NO FLAP SEAM

[75] Inventor: Patrick H. Penven, Clinton, S.C.

[73] Assignee: Asten Group, Inc., Charleston, S.C.

[21] Appl. No.: 346,373

[22] Filed: Apr. 28, 1989

Related U.S. Application Data

[63] Continuation of Ser. No. 177,670, Apr. 5, 1988, abandoned.

[51] Int. Cl.[4] ..... D21F 7/10; D21F 3/00

[52] U.S. Cl. ..... 162/199; 28/141; 139/383 A; 162/273; 162/358; 162/DIG. 1; 428/234; 428/300

[58] Field of Search ..... 162/DIG. 1, 199, 348, 162/358, 273; 138/383 A, 383 AA; 428/300, 223, 234; 156/148, 159, 258, 304.1, 304.3–304.7; 28/141, 142, 110

[56] References Cited

U.S. PATENT DOCUMENTS

| | | | |
|---|---|---|---|
| 4,279,676 | 7/1981 | Morrison et al. | 156/159 |
| 4,601,785 | 7/1986 | Lilja et al. | 162/199 |
| 4,683,624 | 8/1987 | Dufour | 28/141 |
| 4,737,241 | 4/1988 | Gulya | 162/199 |
| 4,743,482 | 5/1988 | Johansson et al. | 428/57 |

FOREIGN PATENT DOCUMENTS

| | | | |
|---|---|---|---|
| 1958335 | 5/1971 | Fed. Rep. of Germany | 156/148 |
| 1956412 | 6/1971 | Fed. Rep. of Germany . | |
| 55-358 | 2/1982 | Japan | 162/DIG. 1 |

OTHER PUBLICATIONS

Interoffice Correspondence, Asten Group, Inc., 9/17/86, 3 pages.

*Primary Examiner*—Karen M. Hastings
*Attorney, Agent, or Firm*—Volpe and Koenig

[57] ABSTRACT

An improved seamed papermaker's press felt of the type having a pintle seamed base fabric and at least one layer of batt material affixed thereto is disclosed. The improvement resides in the provision of an angled slit through the batt material adjacent to the seam. By means of the angled splice, a need for a flap overlying the seam is avoided.

4 Claims, 1 Drawing Sheet

METHOD OF MAKING A PAPERMAKER'S FELT WITH NO FLAP SEAM

This application is a continuation of application Ser. No. 177,670, Filed 4/5/88, now abandoned.

BACKGROUND OF THE INVENTION

1. Field of the Invention

The present invention finds particular application in papermaker's felts which are employed in the press section of a papermaking machine. As will be known to those skilled in the art, papermaking machines generally include three sections which are generally referred to as the formation, press and dryer sections.

A felt is generally employed to transport the formed, wet sheet through the press and dryer sections of the papermaking equipment. The felt must be particularly adapted to specific conditions encountered in papermaking.

Typically, such felts include a supporting base, such as a fabric woven from yarns or formed from spirals, and a paper carrying or supporting layer fixed to the base. Generally, the paper carrying or supporting layer is softer and smoother than the base layer. Frequently, the base fabric is encased in felt material and felt layers will form both the paper carrying surface and the machine contact surface of the felt.

Slight irregularities or imperfection in the support layer are undesirable in virtually all papermaking operations. Inconsistencies in the felt thickness, gauge or weight can cause undesirable characteristics in the paper or undesirable vibrations during operation of the equipment. Typically, the support layer is a non-woven batt material which has been affixed to the base and has homogeneous characteristics as to permeability, compaction and drainage.

Typically, a papermaker's felt will employ a base fabric which is woven and used as an endless loop. In such an endless felt, there is generally no seam. Although there are some endless woven felt designs which incorporate a seam, seams are generally emplòyed for closing a flat woven fabric into an endless loop. The seam may be of the pin type which utilizes an on machine closure device to complete the loop or of the woven type in which the seam area is back woven to form an endless loop.

The present invention is primarily concerned with papermaker's fabrics which are woven and then formed into an endless loop through the use of a joining wire or pintle. These seams are generally called "pin-seams". As will be recognized by those skilled in the art, it is essential that the seam area be substantially consistent in characteristics with the rest of the fabric. Variations in fabric quality at the seam and/or variations in the seam air permeability, compaction or drainage characteristics may adversely affect the felt life or product quality.

Installation of the seamed felts is generally accomplished by slitting the felt in the area of the seam and removing the pintle. Once the fabric has been installed on the equipment, the pintle is reinserted to close the fabric seam. As a result of cutting or slitting the felt, various difficulties have been experienced with the reliability of the seam. Accordingly, the art has sought to achieve a seamed felt in which the characteristics of the seam area were substantially the same as those of the remainder of the felt.

2. Description of the Prior Art

U.S. Pat. No. 4,601,785 discloses a seamed felt in which the batt layer is cut at a predetermined distance away from the seam and freed from the base, thereby creating a flap. The flap of batt material is intended to overlie over the seam after the fabric ends are joined together. In this approach to seaming a felt, the seaming joint and the abutting ends of the batt material splice lie in different parallel vertical planes.

U.S. Pat. No. 4,279,676 discloses a multi-ply felt formed into an endless loop by a spl,,icing method in which the ends of the multiple plies are offset and used to protect the seam by being formed into flaps which overlie the seam after closure thereof.

Papermaker's felts having a flap over the seam area have been found acceptable in some applications. However, formation of the flap on the felt during seaming can be both cumbersome a nd can result in undesirable operating characteristics. Problems of bounce, excessive felt wear and poor product quality have been associated with flaps which performed less than perfectly. Also, if the flap is not properly resecured after closing of the seam, marking of the end product and adverse wear to the felt and equipment can be caused by the unsecured flap. Experience has shown that the area of the felt adjacent the flap area frequently has different air permeability and water drainage characteristics and may have a different caliper than the remainder of the fabric.

The present invention seeks to address the prior art problems with a solution that is relatively simple and easily implemented.

SUMMARY OF THE INVENTION

A seamed papermaker's felt and a method of making the seam are disclosed. The method comprises the steps of determining the intended running direction of the felt on the papermaking machine; removing the pintle from the pin seam; providing a support means for supporting the felt in the area adjacent the seam; orienting the felt on said support means with the batt layer in the up position; folding the felt back upon itself to open the seam and expose the bottom surface of; cutting the batt layer directly adjacent the open seam in a direction opposite to the running direction of the felt so as to create an angled splice extending from the bottom of the batt layer adjacent to the seam and angling outwardly by at least 10 degrees. The felt produced by the method is a seamed felt with a splice extending through the batt material to the seam itself. The splice is angled at least 10 degrees off the plane perpendicular to the seam and in the direction opposite the machine running direction of the felt.

DETAILED DESCRIPTION

The present invention is directed to a method of forming a batt spliced seam in a papermaker's felt and the seam formed thereby. The present invention will be described with respect to a single ply woven base fabric having batt material on either side thereof. However, it will be understood that the present invention may be employed with other felt designs.

Figure 1:
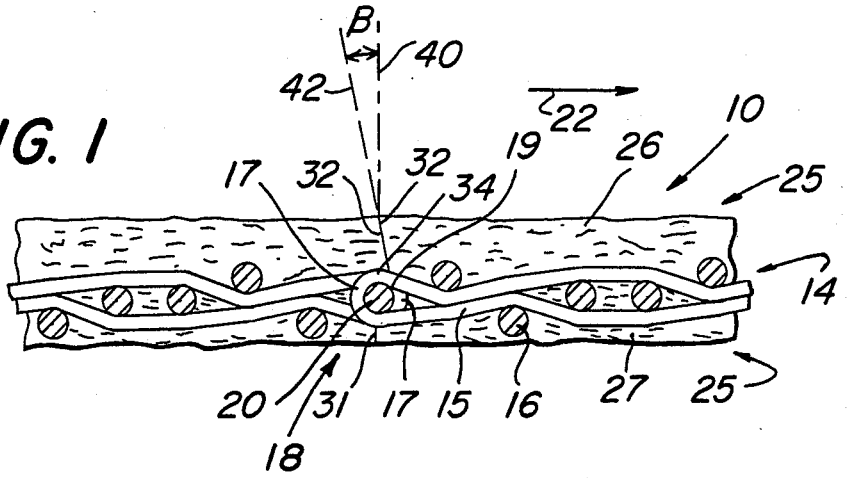
FIG. 1 is a cross sectional side elevation of a seam area in a papermaker's felt in accordance with the present invention.

With reference to FIG. 1, papermaker's felt 10 includes a woven base fabric 14. The base fabric 14 is formed from interwoven machine direction yarns 15 and cross machine direction yarns 16. The term machine direction and cross machine direction relate to the orientation of the fabric on the papermaking machine rather than in the loom. Additionally, it will be understood that the base fabric 14 may be of a spiral construction which will be known to those skilled in the art. The fabric seam illustrated in FIG. 1 is in accordance with and was prepared following the method of the present invention. The seam is shown as it would appear installed on a papermaking machine.

Still with reference to FIG. 1, the respective ends of the fabric 14 are joined into loops 17. As will be known to those skilled in the art, the seam 18 is formed by intermeshing the loops 17 of the respective ends until they form a passage way 19 through which a pintle or joining wire 20 is inserted. The machine direction yarns 15 extend in the machine running direction, indicated by the arrow 22 when the seam is closed. Similarly, the edges 34 of the abutting splice surfaces 32 will be the leading edge of the splice and will be oriented in the same direction as 22.

Figure 2:
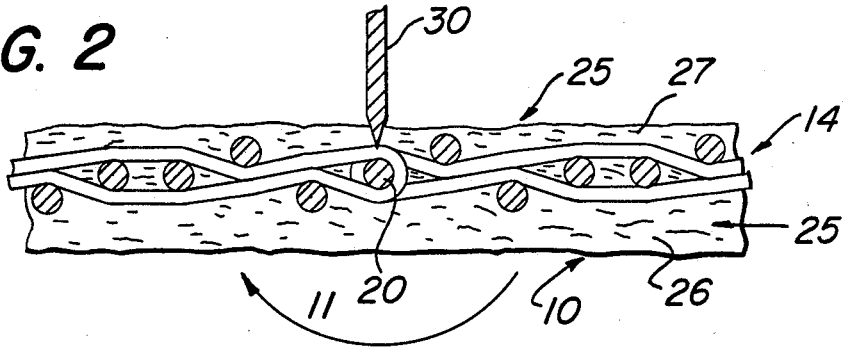
FIG. 2 is a cross sectional side elevation of the seam area during the first cutting step in the method for forming the seam of FIG. 1.
Figure 3:
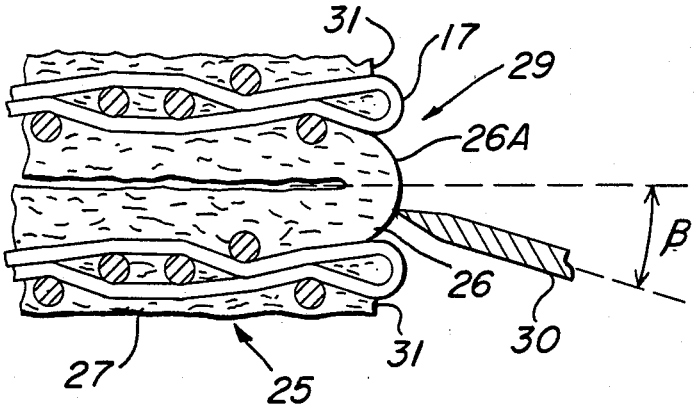
FIG. 3 is a cross sectional side elevation of the seam area during the second cutting step in the method for forming the seam of FIG. 1.

As can be seen with reference to FIG. 1, batt material, generally designated as 25, is affixed to both sides of base fabric 14. As depicted in FIGS. 1 through 3, base fabric 14 is provided with layers 26 and 27 of batt material 25. It can be seen that the layers 26 and 27 have been illustrated as being of different thicknesses. This differentiation is for ease of illustration and the layers 26 and 27 may be of equal thickness.

With reference to FIG. 1, the thicker batt layer 26 is illustrated as being the top layer or paper carrying surface of the felt 10 while the thinner batt layer 27 is shown as the lower layer or machine side surface of the felt. In the preferred embodiment, the layers of batt material are affixed to the base fabric by needling. As will be known to those skilled in the art, the layers of batt material are affixed to the base fabric while the fabric is closed or seamed. Accordingly, the batt layers 26 and 27 must be cut or spliced and the pintle 20 removed in order to release the end loops 17 of the fabric 10 and allow them to be separated and the fabric ends opened.

With reference to FIG. 2, there is illustrated a fabric 10 which has been inverted so that the normal machine side surface or lower layer 27 of batt material is in the upper plane. The fabric is supported on a suitable work surface extending beneath the seam 18 and adjacent thereto. A sharp cutting tool 30, such as scissors or a knife or blade edge, is used to create a cut or splice in the batt material of layer 27 immediately adjacent to and perpendicular to seam 18. This cutting operation produces abutting surfaces 31 in layer 27. Ideally, the tip of the cutting tool 30 will lie in a vertical plane which extends through the center of pintle 20. As will be appreciated by those skilled in the art, care is taken not to sever or damage the loops 17. With this in mind, it has been found that a sharp pair of scissors will perform quite satisfactorily. Likewise, a cutting tool which includes a protective pawl overlying the loop would be acceptable.

After layer 27 has been cut, the pintle 20 is removed from seam 18 and the felt 10 is folded back upon itself in the direction of arrow 11. The resulting configuration is depicted in FIG. 3.

With reference to FIG. 3, it can be seen that the paper carrying surface or top layer 26 of batt material 25 has been folded back upon itself in a face to face orientation. This orientation exposes the inner or bottom surface 26A of top layer 26 at the open seam area 29. A cut or splice is then made in top layer 26 by a cutting tool 30. The tool 30, under controlled pressure, is pushed through layer 26 so as to sever it. Tee cut made by tool 30 is not perpendicular to the seam through the base fabric. In fact, it is intended that layer 26 be cut at an angle $\beta$ with respect to the perpendicular through the seam.

Referring again to FIG. 1, the plane 40 extends perpendicular to and through the center of pintle 20. Plane 40 is substantially on centerline with pintle 20 and the abutment of surfaces 31. The plane 42 extends at an angle B with respect to the perpendicular plane 40. Preferably, the angle $\beta$ ranges from at least 10 to about 25 degrees off the perpendicular 40 in the direction opposite the machine running direction, arrow 22. Stated differently, the splice surfaces 32 will always be oriented such that the leading edges 34 are in the running direction of the felt.

It will be noted that the splice cuts to both layers of the batt material 25 are made without dislodging the batt material 25 from the base fabric 14. Accordingly, the abutting face surfaces of the layers 26 and 27 will be realigned when the seam is closed. Thus, the area of the seam will be covered without the necessity of creating a flap which extends beyond the seam area and without separation of the batt material from the base fabric.

While the invention has been described with respect to a single layer woven base fabric, the present techniques may be applied to other fabrics. For example, in a superimposed, seamed felt comprised of a seamed woven base fabric with a super imposed system of a second fabric layer and batt layers the seam may be prepared in accordance with the present method. Upon opening of the seam in the base fabric and folding back of the base fabric, the upper fabric and batt layers may be cut as described herein with respect to the upper layer of batt material 26. Upon closing of the seam, the cut or abutting faces of the fabric layers will align in accordance with the present invention. Once again, the ability to avoid loosening of the layers from the base fabric in the seam area results in improved wear resistance and running characteristics for the felt in the seam area.

What is claimed:

1. A method of forming a seam splice in a papermaker's felt having at least one batt layer affixed thereto, said method comprising the steps of:

(a) determining the intended running direction of said felt on the papermaking machine;

(b) opening the fabric seam;

(c) providing a support means for supporting the felt in the area adjacent the seam;

(d) orienting the felt on said support means with the batt layer in a topmost position;

(e) folding the felt back upon itself to expose the bottom surface of said batt through said open seam; and (f) cutting said batt layer directly adjacent said open seam in a directing opposite to the running direction of the felt so as to create an angled splice beginning at the bottom of said batt layer adjacent to the seam and angling outwardly by at least 10 degrees from a perpendicular through the seam.

2. The method of claim 1 wherein said angled splice is in the range of 10 to 25 degrees off the perpendicular plane through said seam in said felt.

3. A method of forming a seam splice in a papermaker's felt having at least one top and one bottom batt layer affixed to the top side and the bottom side, respectively, of a base fabric which has a rejoinable seam, said method comprising the steps of:

(a) determining the intended running direction of said felt on the papermaking machine;

(b) making a substantially perpendicular cut through the bottom batt layer to said base fabric seam;

(c) opening the base fabric seam;

(d) providing a support means for supporting the felt in the area adjacent the seam;

(e) orienting the felt on said support means with he top batt layer in a topmost position;

(f) folding the felt back upon itself to expose the bottom surface of said top batt layer through said cut bottom batt layers and said open seam; and (g) cutting through said top batt layer directly adjacent said open seam so as to create an angled splice beginning at the bottom of said batt layer adjacent to the seam and angling outwardly by at least 10 degrees from a perpendicular through the seam in a direction opposite to the running direction of the felt.

4. The method of claim 3 wherein said angled splice is in the range of 10 to 25 degrees off the perpendicular plane through said seam in said felt.

* * * * *

UNITED STATES PATENT AND TRADEMARK OFFICE

CERTIFICATE OF CORRECTION

PATENT NO. : 4,902,383

DATED : February 20, 1990

INVENTOR(S) : Patrick H. Penven

It is certified that error appears in the above-identified patent and that said Letters Patent is hereby corrected as shown below:

Column 2, line 10, delete the words "spl,,icing" and insert therefor --splicing--.

Column 2, line 17, delete the words "a nd" and insert therefor --and--.

Column 4, line 12, delete the word "Tee" and insert therefor --The--.

Column 4, line 21, delete the letter "B" and insert therefor --ß--.

Column 4, line 40, delete the words "super imposed" and insert therefor --superimposed--.

Claim 1, column 4, line 68, delete the word "directing" and insert therefor --direction--.

Claim 3, column 6, line 3, delete the word "he" and insert therefor --the--.

Signed and Sealed this

Twelfth Day of March, 1991

*Attest:*

HARRY F. MANBECK, JR.

*Attesting Officer*

*Commissioner of Patents and Trademarks*